United States Patent [19]

Davis

[11] Patent Number: 4,555,829

[45] Date of Patent: Dec. 3, 1985

[54] SUPPORTING STAYS FOR SWINGABLE WINDOWS HAVING FRICTION AND SLIDING PIVOTS

[75] Inventor: Ronald P. Davis, Wellington, New Zealand

[73] Assignee: Interlock Industries Limited, Wellington, New Zealand

[21] Appl. No.: 559,877

[22] Filed: Dec. 9, 1983

[30] Foreign Application Priority Data

Dec. 9, 1982 [NZ] New Zealand ..... 202754
Mar. 14, 1983 [NZ] New Zealand ..... 203553

[51] Int. Cl.[4] ..... E05D 11/08; E05D 15/32

[52] U.S. Cl. ..... 16/342; 16/361; 16/368; 16/370; 49/250

[58] Field of Search ..... 16/342, 360, 361, 368, 16/369, 370; 49/248, 250, 251, 252

[56] References Cited

U.S. PATENT DOCUMENTS

| | | | |
|---|---|---|---|
| 1,920,898 | 8/1933 | Soule | 16/360 |
| 3,797,169 | 3/1974 | Armstrong | 49/248 |
| 3,939,529 | 2/1976 | Davis | 16/342 |
| 4,102,012 | 7/1978 | Davis | 49/248 X |

FOREIGN PATENT DOCUMENTS

| | | | |
|---|---|---|---|
| 589064 | 6/1947 | United Kingdom | 49/252 |
| 2025499 | 1/1980 | United Kingdom | 49/252 |
| 2047309 | 11/1980 | United Kingdom | 16/360 |

*Primary Examiner*—Fred Silverberg
*Attorney, Agent, or Firm*—Young & Thompson

[57] ABSTRACT

A window stay comprises a pair of mounting plates, one being adapted for mounting to a window frame and the other being adapted for mounting to a window sash. The frame and sash mounting plates are coupled together by first and second arms, the first arm being shorter than said second arm, each of the first and second arms being pivotally connected to the sash mounting plate. The first arm is pivotally connected at a fixed point to the frame mounting plate. There is a third arm pivotally connected to the second arm, one of the second arm and said third arm being pivotally connected at a fixed point to the frame mounting plate and the other of the second and third arms being pivotally and slidingly connected to the frame mounting plate for sliding movement in a substantially longitudinal direction along the frame mounting plate.

8 Claims, 4 Drawing Figures

SUPPORTING STAYS FOR SWINGABLE WINDOWS HAVING FRICTION AND SLIDING PIVOTS

Figure 1:
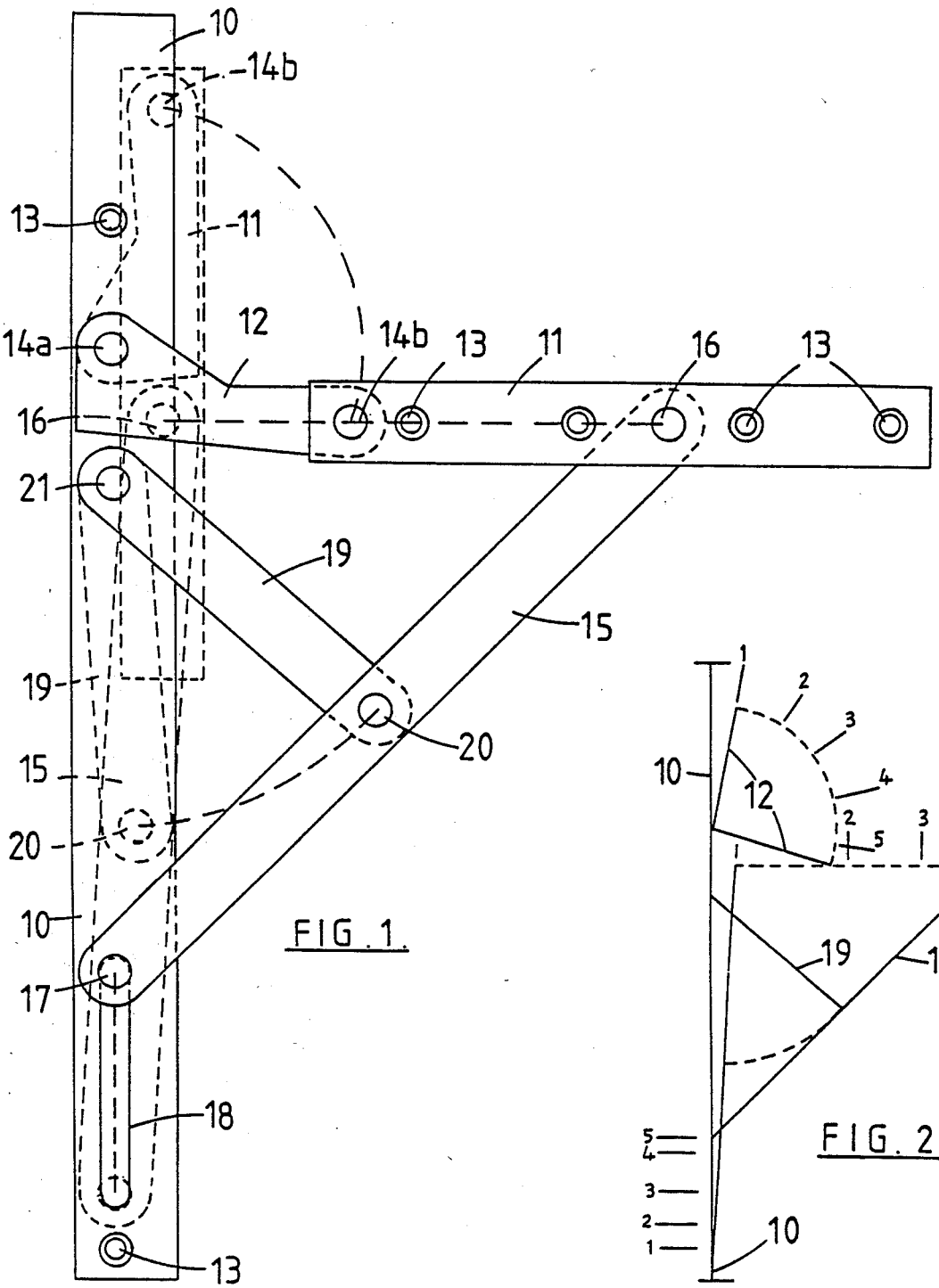

This invention relates to supporting stays for the swingable adjustable mounting of a window in a window frame.

The invention more particularly relates to a window stay which comprises a pair of mounting plates one being adapted for mounting to a window frame and the other being adapted for mounting to a window sash. These frame and sash mounting plates are coupled together by a pair of arms, one arm being shorter than the other. Each arm is pivotally mounted by one end to the sash mounting plate whilst the other end of each arm is pivotally coupled to the frame mounting plate. Preferably the pivot joint between arm and mounting plate is of a friction type such that in use the window is held in any desired degree of opening.

Throughout the specification reference will be made to frame or sash mounting plates. The term "mounting plate" is, however, to be taken to be a reference to either a single mounting plate or two separate mounting plates. In addition, reference is made to friction pivot joints. These joints can either be of the types described in U.S. Pat. Nos. 3,497,909 and 4,441,835, however, it is preferred that the friction joints be of the type described in my U.S. patent application Ser. No. 541,735. The contents of these as far as they relate to the construction and arrangement of friction pivot joints are incorporated into this specification by way of reference.

Such window stays are commonly used for top-hung or awning windows, however, they also have application with side-hung or casement windows. It is desirable that with side-hung or casement windows a 90° angle of opening can be achieved as this not only provides for good ventilation, where ventilation is a prime requirement, but also allows the outside surface of the window to be cleaned from inside the building. With these types of stays a 90° angle of opening can either be achieved by the stay having a sliding action incorporated in its design or by the geometry of the stay being such that the end of the long arm attached to the sash plate passes the end of the short arm attached to the frame mounting plate. The latter arrangement suffers from the problem that the pivot bearings must be close together and this results in difficulties in achieving sufficient friction or strength. On the other hand stays having a sliding action suffer from the difficulty of obtaining consistent friction in that usually there is too little friction in the first few degrees of opening and too much friction when the stay is at or approaching the fully opened position. In addition the weight of the window is always over the element having the sliding action and this weight adds to the already difficult friction control.

The stay according to one embodiment of the present invention is one which is particularly suitable for use in side-hung or casement windows but does not suffer from the aforementioned problems normally associated with such stays. The stay according to the invention is characterized in that the pivot coupling of the longer arm to the frame mounting plate is mounted for sliding movement along the mounting plate. There is also provided a third arm which is pivotally coupled by one end to the longer arm and at its other end to the frame mounting plate. In the preferred form the third arm is pivotally coupled to the longer arm at a point substantially midway between the pivot couplings of the longer arm to the mounting plates. The other end of the third arm is pivotally mounted to the frame mounting plate at a point between the pivot couplings of the first and second arms to that plate but preferably adjacent the pivot mounting of the shorter arm.

With the move toward large dimension window sashes or sashes which, due to double or even triple glazing, are extremely heavy, new demands are being placed on window stays. To be able to handle these types of sashes, friction type window stays have needed to be increased in not only strength but also in physical dimensions so that reliance is not placed solely on the friction in the window stay to hold the sash in an open position but also in the geometry of the stay so that at wider degrees of opening a counter-balancing action assists the friction in the stay.

Window stays are commonly constructed from either stainless steel or an aluminum alloy. Stainless steel does have the advantage that higher strength in the components can be obtained without the need to have thick cross-section arms and mounting plates as is the case when the components are of aluminum alloy. A cost factor does, however, arise in that stainless steel is considerably more expensive than aluminum alloy. Accordingly, large dimension stays when constructed from stainless steel are extremely expensive. There is thus a need for a compact window stay which is not so reliant on counter-balancing to hold the window sash open.

The stay according to a second embodiment of the present invention is one which is particularly suitable for top-hung or awning windows and whilst being of compact overall dimensions is one which is able to carry either lage dimension sashes or sashes which are of heavy weight due, for example, to double or triple glazing. The stay is accordingly characterized in that a third arm is pivotally coupled by one end to the longer arm of the stay and is coupled at its other end to the frame mounting plate such that it is capable of sliding movement. In the preferred form of the invention the frame mounting plate is formed as two separate mounting plates, one being pivotally coupled to the longer arm and the other being coupled to the shorter arm and the aforesaid third arm.

Figure 2:
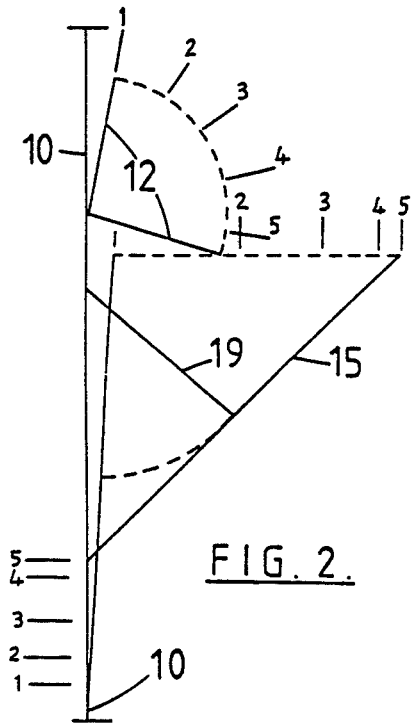
Figure 4:
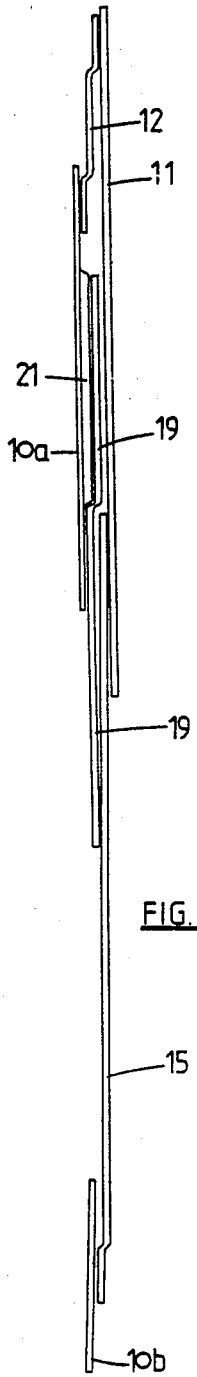
Figure 3:
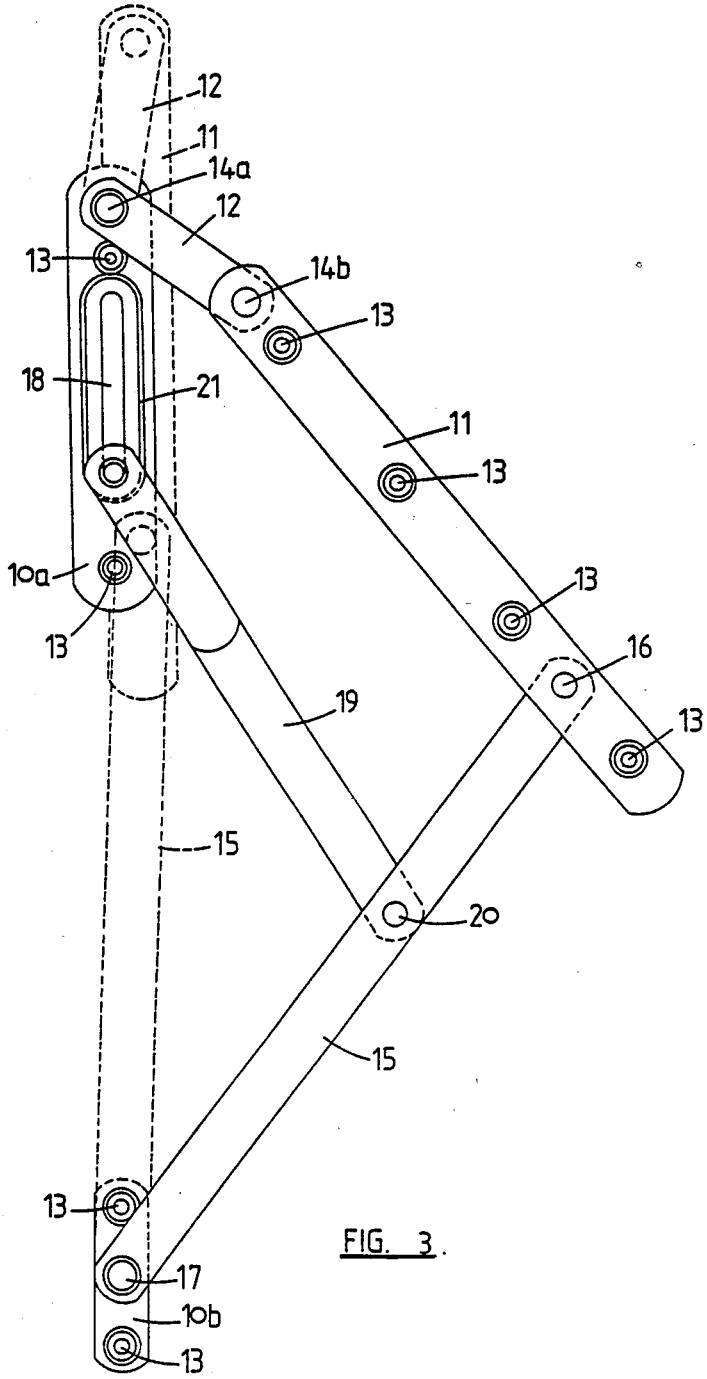

In the more detailed description of the invention which follows reference will be made to the accompanying drawings in which:

FIG. 1 is an elevational view of one embodiment of the stay showing the closed and fully opened positions, FIG. 2 is a schematic illustration of the geometry of the stay shown in FIG. 1, FIG. 3 is an elevational view of a second embodiment of the stay shown in an opened position but with the closed position shown in dotted detail, and FIG. 4 is a side elevational view of the stay of FIG. 3 in its closed position.

In the illustrated form in FIGS. 1 and 2, the stay consists of a single mounting plate 10 adapted for attachment to the frame of a window and a single mounting plate 11 which is adapted for mounting to the sash of a window. Openings 13 are provided in plates 10 and 11 for mechanical fastenings of which the friction pivot joints are of the type described in U.S. application Ser. No. 541,735, which mechanical fastenings can, if desired, be engaged through the centers of the pivot joints.

The shorter or first arm 12 is pivotally mounted between the plates 10 and 11 by pivot joints 14*a*, 14*b*. The longer or second arm 15 is pivotally coupled at 16 to plate 11. The other end of arm 15 is pivotally coupled at 17 to plate 10. This pivot coupling 17 is formed as part of a slide (not shown) and the movement of the slide, and hence pivot 17, is controlled by a longitudinally disposed elongate slot 18 formed in plate 10. In the preferred form of the stay pivots 14 and 16 are friction type pivot joints and the slide is a friction slide. In applications where the stay is either of small dimensions or carries a very light sash pivots 14 and 16 do not need to be of a friction type as sufficient friction can be derived from the slide.

Extending between plate 10 and arm 15 is a third arm 19. This arm 19 is pivoted at 20 to arm 15 with the axis of pivot being substantially medially between pivot 16 and 17 but preferably slightly toward pivot 17. The other end of arm 19 is pivoted at 21 to mounting plate 10 at a position which is preferably adjacent to pivot 14*a* of arm 12.

FIG. 1 of the drawings shows the stay both in the closed position, where arms 15 and 19 and mounting plate 11 lie substantially over mounting plate 10, and in the fully open position where plate 11 is situated substantially at right angles to mounting plate 10. The drawing indicates that during opening, the stay pivot joint 16 moves in a rectilinear manner, as does pivot joint 17, whilst pivot joints 20 and 14*b* move on the indicated arcs. The straight out and back movement of pivot 16 is achieved by the pivot 14*b* moving on its arc at the same time as the end of arm 15 moves rectilinearly on plate 10. Unlike the normal situation with a stay having a sliding action where the slide movement increases as the opening of the stay increases the present stay operates with a more constant movement of the slide. This can be ascertained from FIG. 2 of the drawings where the graduated scales indicate the extent of movement of the slide (and hence pivot 17) relative to the extent of movement of pivots 14*b* and 16. It is notable that in the initial few degrees of opening of the stay the slide moves an amount which is not significantly less than the amount of movement between positions 2, 3 and 4 of the pivots 14*b* and 16. The ability to achieve this type of movement of the slide overcomes the friction adjustment problem which is normally associated with stays having a sliding action. In addition the present stay is one, which in a casement application, does not have the weight of the sash over the slide.

With a slight alteration to the geometry the present window stay can also be used for awning windows though this alteration in geometry would reduce the angle of opening.

A modification of the window stay is the provision of a rubber stop or the like placed at the top of the slot 18. The provision of this rubber stop would allow the shorter arm 12 to be pushed into an over-center position in the fully opened configuration thereby locking the window in that open position. The rubber stop absorbs any forces created due to the arm being swung over-center.

This form of the stay can (as with the form shown in FIGS. 3 and 4 hereinafter described) have the frame mounting plate 10 formed by two separate plates, one pivotally coupled to arms 12 and 19 and the other slidingly connected to arm 15. One advantage with such an arrangement is that the stay can be mounted on both sides of the window as opposed to the stay shown in FIG. 1 where right and left handed constructions are necessary.

Referring to FIGS. 3 and 4 a second embodiment of the invention is shown and elements of the stay which are common to the first embodiment have the same reference numerals. The frame mounting plate is of two part construction as indicated at 10*a* and 10*b* with arm 12 pivoted at 14*a* to plate 10*a* and at 14*b* to plate 11. Third arm 19 is coupled to plate 11*a* whilst arm 15 is pivoted at 17 to plate 10*b*.

Arm 19 is pivoted at 20 to arm 15 with the axis of pivot being located so as to be closer to pivot 16. The other end of arm 19 is coupled to mounting plate 10*a* and is able to slide longitudinally along the mounting plate 10*a* during opening and closing of the stay.

Elongate slot 18 extends longitudinally of plate 10*a* and this slot 18 is formed in a raised portion 21. Arm 19 is coupled to the raised portion 21 by mechanical fastening 22 which is slidingly located within slot 18. In its simplest form mechanical fastening 22 can be a screw, the head of which is located within the confines of raised portion 21 and the tail of which is threaded into a threaded opening in arm 19. In the preferred form, however, a hollow spigot formed integrally in arm 19 (in the manner substantially as described in aforesaid U.S. patent application Ser. No. 541,735) projects through slot 18 and this hollow spigot is internally threaded to accept the threaded shank of a headed screw. Preferably a wear-resistant plastics material such as nylon which is in the form of a flanged sleeve is engaged over the spigot so that the flanged portion separates the facing surfaces of arm 19 and the raised portion of 21 surrounding slot 18 whilst the sleeve portion separates the surface of the spigot from the walls of slot 18. In a known manner the free end of the nylon sleeve is deformed by the underside of the head of the screw such that the underside of the head of the screw is separated from the surface of the plate 18 and a friction type joint is thus formed. A mechanical fastening of this type thereby forms an adjustable friction slide between arm 19 and plate 10*a*.

In the preferred form all pivot joins are of a friction type and thus the stay has not only the adjustable friction slide but also five friction pivot joints. A high friction level can thus be achieved for a stay of compact dimensions and this friction level is able to be adjusted by adjustment of the mechanical fastening between arm 19 and mounting plate 10*a*.

In the preferred form as previously mentioned the mounting plates and arms are formed of stainless steel and thus they can be of narrower thickness than would be the case if they were manufactured from an aluminum alloy. This form of the stay is economical to produce and this is to a certain degree facilitated by the ability to have two frame mounting plates rather than a single frame mounting plate. As can be observed in FIG. 3 frame mounting plate 10*a* is of considerably wider dimensions than that of plate 10*b* and this enables the slot 18 to be formed in the integrally raised portion 21.

What is claimed is:

1. A window stay comprising a pair of mounting plates, one being adapted for mounting to a window frame and the other being adapted for mounting to a window sash, said frame and sash mounting plates being coupled together by first and second arms, said first arm being shorter than said second arm, each of said first and second arms being pivotally connected to said sash mounting plate and said first arm being pivotally connected at a fixed point to said frame mounting plate, there being a third arm pivotally connected to said second arm, one of said second arm and said third arm being pivotally connected at a fixed point to said frame mounting plate and the other of said second and third arms being pivotally and slidingly connected to said frame mounting plate for sliding movement in a substantially longitudinal direction along said frame mounting plate.

2. The window stay according to claim 1 wherein said frame mounting plate is formed by two separate mounting plates, one of which is connected to said second arm and the other of which is connected to both said first and third arms.

3. The window stay according to claim 2 wherein the third arm is pivotally connected to said longer arm at a point in the length of the longer arm which is closer to the pivot connection of the longer arm to the sash mounting plate than to the frame mounting plate, said longer arm being pivotally connected to said frame mounting plate.

4. The window stay according to claim 1 wherein an elongated substantially longitudinally disposed slot is formed in said mounting plate, a sliding pivot being located for sliding movement along said slot, said sliding pivot being coupled to the second arm.

5. The window stay according to claim 1 wherein the third arm is pivotally connected to said second arm substantially medially in the length of said second arm with the other end of said third arm being pivotally connected to said frame mounting plate adjacent to the pivot mounting of said first arm to said frame mounting plate.

6. The window stay according to claim 5 wherein the pivotal connection of the third arm to the second arm is disposed slightly toward the connection of the second arm to the frame mounting plate.

7. The window stay according to claim 1 wherein each of the pivot connections is of a wear resistant friction type.

8. The window stay according to claim 1 wherein an elongated substantially longitudinally disposed slot is formed in said mounting plate, a sliding pivot being located for sliding movement along said slot, said sliding pivot being coupled to the third arm.

* * * * *